US006998010B2

(12) United States Patent
Wiley

(10) Patent No.: US 6,998,010 B2
(45) Date of Patent: Feb. 14, 2006

(54) METHOD AND APPARATUS FOR HEATING SURFACE MARKINGS

(75) Inventor: Patrick Carl Wiley, Chilliwack (CA)

(73) Assignee: Integrated Paving Concepts Inc., Surrey (CA)

( * ) Notice: Subject to any disclaimer, the term of this patent is extended or adjusted under 35 U.S.C. 154(b) by 199 days.

(21) Appl. No.: 10/622,633

(22) Filed: Jul. 21, 2003

(65) Prior Publication Data

US 2004/0103988 A1 Jun. 3, 2004

(51) Int. Cl.
*B32B 37/00* (2006.01)

(52) U.S. Cl. ..... 156/309.6; 404/79

(58) Field of Classification Search ..... 156/308.2, 156/309.6, 359, 380.9, 499; 404/77, 79, 404/95

See application file for complete search history.

(56) References Cited

U.S. PATENT DOCUMENTS

| | | | |
|---|---|---|---|
| 1,063,752 | A | 6/1913 | Walling |
| 1,950,169 | A | 3/1934 | Farasey |
| 2,196,890 | A | 4/1940 | Bensen |
| 2,237,152 | A | 4/1941 | Larmour |
| 2,595,142 | A | 4/1952 | Herck |
| 2,866,992 | A | 1/1959 | Toulmin, Jr. |
| 2,898,825 | A | 8/1959 | Walker et al. |
| 3,410,185 | A | 11/1968 | Harrington |
| 3,664,242 | A | 5/1972 | Harrington et al. |
| 3,832,079 | A | 8/1974 | Moorhead |
| 3,874,806 | A | 4/1975 | Grist et al. |
| 3,910,711 | A | 10/1975 | Moorhead |
| 4,082,587 | A | 4/1978 | Eigenmann |
| 4,105,354 | A | 8/1978 | Bowman |
| 4,135,840 | A | 1/1979 | Puccini et al. |
| 4,376,007 | A | 3/1983 | Eigenmann |
| 4,685,824 | A | 8/1987 | Eigenmann |
| 4,776,723 | A | 10/1988 | Brimo |
| 4,792,259 | A | 12/1988 | Eigenmann |
| 4,854,771 | A | 8/1989 | Corbin, Jr. et al. |
| 4,889,666 | A | 12/1989 | Kawasaki |
| 5,033,906 | A | 7/1991 | Jordan |
| 5,133,621 | A | 7/1992 | Gonzales |
| 5,215,402 | A | 6/1993 | Stowell et al. |
| 5,421,670 | A | 6/1995 | Meirick |

(Continued)

FOREIGN PATENT DOCUMENTS

| | | |
|---|---|---|
| CA | 2 361 056 | 5/2002 |

(Continued)

OTHER PUBLICATIONS

English abstract for JP 05098613.*

(Continued)

*Primary Examiner*—Jeff H. Aftergut
*Assistant Examiner*—John L. Goff
(74) *Attorney, Agent, or Firm*—Oyen Wiggs Green & Mutala LLP

(57) ABSTRACT

This application relates to a method and apparatus for heating a surface marking, such as a thermoplastic pattern in an asphalt substrate. The marking may be selected for functional or decorative purposes. The method involves gradually applying heat to the marking to avoid scorching and to ensure a consistent bond with the underlying substrate, even in the case of markings having a very large surface area. In one embodiment the method a portable heating apparatus is provided having infrared heaters mounted for reciprocal movement in a travel path periodically passing over the marking and the underlying substrate. The heating method permits direct visual monitoring of the work site to achieve optimum adhesion of the marking to the asphalt or other substrate.

6 Claims, 3 Drawing Sheets

U.S. PATENT DOCUMENTS

| | | | | |
|---|---|---|---|---|
| 5,447,752 | A | | 9/1995 | Cobb |
| 5,487,526 | A | | 1/1996 | Hupp |
| 5,494,372 | A | | 2/1996 | Oliver et al. |
| 5,502,941 | A | | 4/1996 | Zember et al. |
| 5,560,734 | A | | 10/1996 | McIntosh et al. |
| 5,653,552 | A | * | 8/1997 | Wiley et al. ..... 404/77 |
| 5,792,511 | A | | 8/1998 | Oliver et al. |
| 5,857,453 | A | | 1/1999 | Caven et al. |
| 6,024,511 | A | | 2/2000 | Ross |
| 6,213,680 | B1 | | 4/2001 | Schaeffer et al. |
| 6,217,254 | B1 | | 4/2001 | Wallgren et al. |
| 6,227,454 | B1 | | 5/2001 | Wolf et al. |
| 6,303,058 | B1 | | 10/2001 | Kelley et al. |
| 6,382,871 | B1 | | 5/2002 | Ross |
| 6,503,558 | B1 | | 1/2003 | Williamson |
| 2003/0103810 | A1 | | 6/2003 | Wiley |
| 2004/0048025 | A1 | | 3/2004 | Lohnes |

FOREIGN PATENT DOCUMENTS

| | | | | |
|---|---|---|---|---|
| DE | 29 18 860 | | | 11/1980 |
| DE | 43 14 240 | A1 | | 11/1993 |
| EP | 0 898 018 | A1 | | 2/1999 |
| FR | 1 596 269 | | | 7/1970 |
| FR | 2591143 | A1 | * | 6/1987 |
| JP | 05098613 | A | * | 4/1993 |
| JP | 411029905 | A | | 2/1995 |
| JP | 02000345514 | A | | 12/2000 |
| WO | WO 87/02724 | | | 5/1987 |
| WO | WO 03/048458 | A1 | | 6/2003 |

OTHER PUBLICATIONS

English abstract for FR 2591143.*

Cataphote, Cata-Groove Snow Plow Resistant Thermoplastic Marking Material, pp. 1-5, dated Jul. 1998.

3M Guidelines for Pavement Marking Applications in Grooved Pavement Surfaces: Stamark Pavement Marking Tape and Stamark Liquid Pavement Markings, Information Folder 5.18 Grooving Applications (Apr. 2002).

3m Application of Stamark Pre-Cut Symbols and Legends, Information Folder 5.8 (May 2002).

"Pavements and Surface Materials", Techinal Paper No. 8, by Jim Gibbons, 1999.

"Installing thermoplastic crosswalks at the University of Wisconsin", PAVEMENT Magazine, pp. 12-14, Feb. 2004.

PREMARK road marking material, from www.intertraffic.com, no date.

"Distinctive Concrete", from www.distinctiveconcrete.com/products_stamp.htm, no date.

* cited by examiner

METHOD AND APPARATUS FOR HEATING SURFACE MARKINGS

RELATED APPLICATIONS

This application claims priority on pending international application No. PCT/CA02/01864 filed 3 Dec. 2002 which is incorporated herein by reference.

TECHNICAL FIELD

This application relates to a method and apparatus for heating settable surface markings, such as thermoplastic markings applied to roadway or walkway surfaces. The markings may be selected for functional and/or decorative purposes.

BACKGROUND

Various methods for applying markings to roadway and walkway surfaces are known in the prior art. For example, it is well-known in the prior art to apply colored thermoplastic markings to asphalt roadways, such as traffic arrows or lane markings. The markings are fixed in place using heat which causes the settable material to bind to the underlying substrate.

It is also becoming increasingly common to apply surface markings to outdoor substrates for decorative or marketing purposes. For example, corporate logos and advertising designs may be applied to asphalt, concrete or other substrates, such as in parking lots, drive-throughs, store fronts and the like.

Thermoplastic surface markings are typically heated in situ by using hand-held open-flame torches. However, it is very difficult to consistently apply heat to surface markings using such hand-held heaters, particular if the markings are large in size. As a result, two primary problems have arisen, namely overheating and underheating. Often the thermoplastic material is either scorched due to the application of excessive heat or fails to bond consistently to the underlying substrate due to the application of insufficient heat. The failure to establish a consistent bond may result in delamination of the marking from the substrate over time, especially in high traffic areas.

The need has therefore arisen for an improved method and apparatus for gradually and consistently applying heat to surface markings to ensure a consistent bond with the underlying substrate, even in the case of markings having a very large surface area.

SUMMARY OF INVENTION

In accordance with the invention, a method of binding a thermally settable marking to a substrate is described comprising:

(a) positioning said marking on said substrate;

(b) gradually heating said marking and said substrate in situ by periodically passing a heater in proximity to said substrate; and (c) allowing said marking to bind to said substrate when said marking is heated to a sufficiently pliable state.

In one embodiment of the invention the marking may be partially or entirely in-laid within the substrate. The substrate may, for example, comprise an asphalt surface and the marking may be partially or entirely in-laid within an upper portion of the asphalt surface. The marking may be formed from a thermoplastic material.

The Applicant's method may include the step of providing a heating apparatus having a support frame extending over the marking. The method may include moving the heater on the support frame in a path which periodically passes over the marking to gradually increase the temperature thereof. For example, the heater may comprise an infrared heater which moves in a reciprocating motion on the support frame. In some embodiments of the invention multiple infrared heaters movable on the support frame may be provided.

The heater is preferably capable of heating a relatively large surface area, such as greater than 10 square feet, while permitting visual monitoring of the work site.

BRIEF DESCRIPTION OF DRAWINGS

In drawings which illustrate embodiments of the invention, but which should not be construed as restricting the spirit or scope of the invention in any way.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
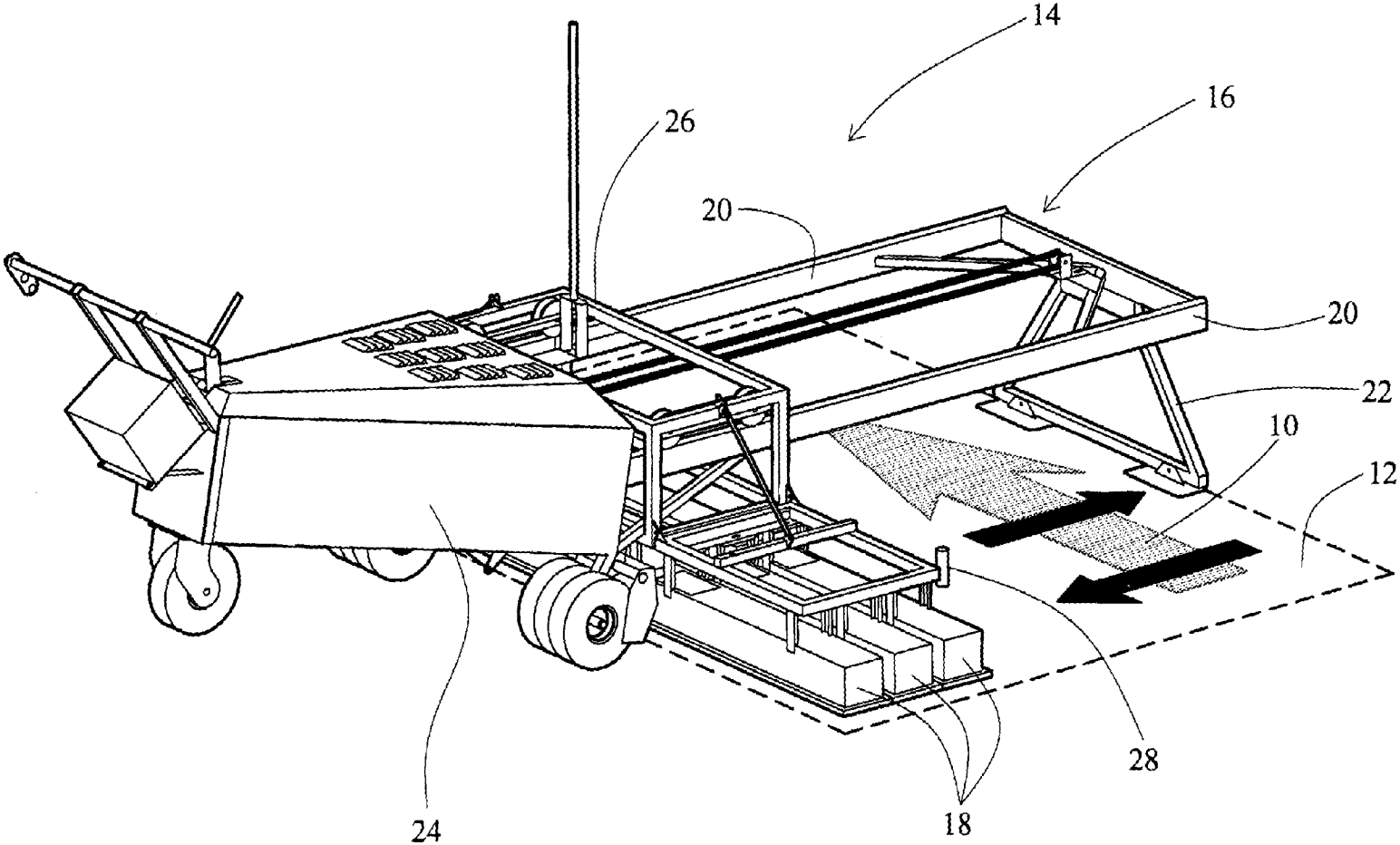
FIG. 1 is perspective view of an apparatus comprising reciprocating infrared heaters for gradually heating a marking applied to a substrate.

This application relates to methods and apparatus for heating settable surface markings 10, such as markings comprised of a thermoplastic material. With reference to FIG. 1, a marking 10 may be applied to a substrate 12 and then gradually heated in situ until a consistent bond is achieved between marking 10 and substrate 12. As used in this patent application the term heating "in situ" refers to heating the marking 10 and substrate 12 at the work site rather than using hot materials heated off-site.

Substrate 12 may comprise, for example, an asphalt surface. As used in this patent application "asphalt" means a paving compound for constructing roads, driveways, walkways and the like which consists of a combination of bituminous binder, such as tar, and an aggregate, such as sand or gravel. As will be appreciated by a person skilled in the art, substrate 12 could also alternatively comprise concrete or other materials capable of binding to thermoplastic markings 10.

Settable markings 10 are well-known and are available from various suppliers. A suitable thermoplastic material is available, for example, from Lafarge Road Markings and is sold under the trademark THERMALINE™. Other suppliers of thermoplastic markings include Flint Trading, Inc. and Avery Dennison Corporation. Marking 10 may selected for a functional purpose, such as a traffic marking or corporate logo, or may be purely decorative.

As shown FIG. 1, a portable surface heating apparatus 14 is provided for heating marker, 10. In the illustrated embodiment apparatus 14 includes a support frame 16 and a plurality of infrared heaters 18 supported for movement on support frame 16. For example, support frame 16 may include elongated rails 20 which are supported above substrate 12 by support legs 22 and housing 24. A heater truck 26 is provided for reciprocating movement on rails 20. Truck 26 supports a bank of infrared heaters 18 at positions close to substrate 12 (e.g. approximately 2 inches above the ground).

Figure 2:
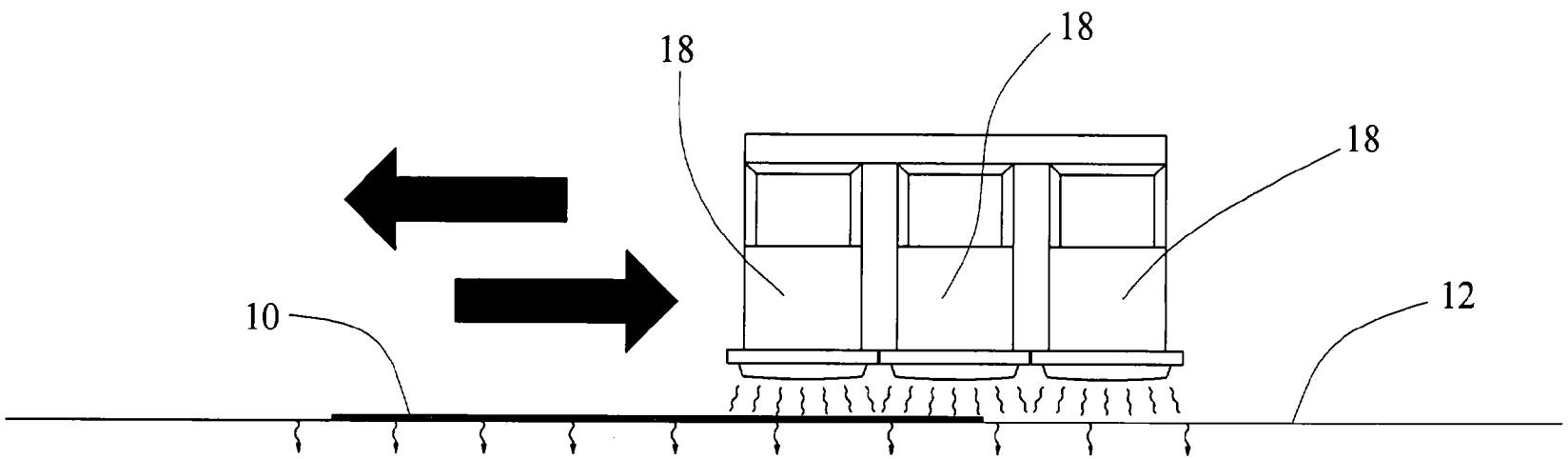
FIG. 2 is an end elevational view of the reciprocating heaters of FIG. 1.
Figure 3:
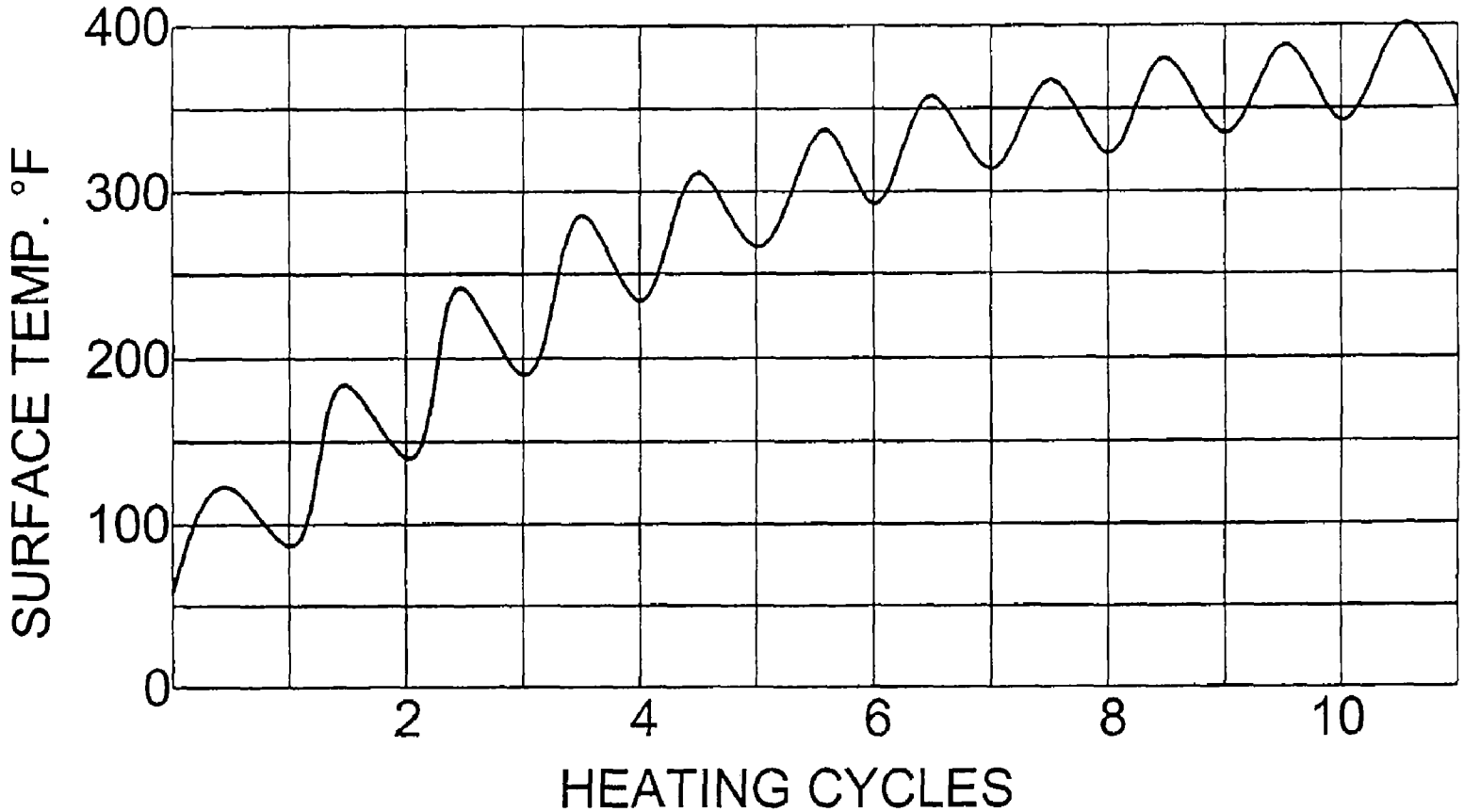
FIG. 3 is a graph showing the gradual increase in the substrate surface temperature with successive passes of the reciprocating heaters of FIG. 1.

As shown in FIGS. 2 and 3, in operation infrared heaters 18 travel back and forth over marking 10 to gradually heat marking 10 and substrate 12. For example, in one embodiment heaters 18 move through three cycles per minute (each cycle being a traversal of truck 26 from housing 24 to the distal end of rails 20 and back again). An important advantage of the heating method of FIG. 1 is that a relatively large marking 10 and underlying substrate 12 can be heated gradually and evenly. This approach avoids the disadvantages of hand-held torch heaters which cannot easily be used to evenly heat large areas and have a tendency to scorch the thermoplastic material and/or the substrate. For example, depending upon its composition, some thermoplastic markings 10 and/or substrates 12 can scorch when subjected to sustained temperatures above approximately 325° F.

FIG. 3 is a graph showing the changing temperature profile of an asphalt substrate 12 with successive passes of heaters 18. Substrate 12 is allowed to cool after each heating cycle. The temperature of substrate 12 (and marking 10 applied thereto) gradually increases with successive heating cycles until the desired temperature suitable for thermoplastic/asphalt adhesion is achieved. The asphalt surface is subjected to a relatively slow heat soak to permit heat to gradually penetrate through and around marking 10 below the uppermost surface layer of the asphalt.

Heating apparatus 14 allows the operator to visually monitor the work site during the heating operation. For example, marking 10 could cover a large surface area. The reciprocating nature of Applicant's heating apparatus 14 enables the operator to visually monitor the heating process while it is ongoing to gauge the degree of adhesion and to avoid underheating or overheating. For example, the operator can determine when marking 10 becomes sufficiently pliable to flow into any interstices or impressions formed in substrate 10, thereby enhancing adhesion to substrate 12. Heater 14 is then removed and marking 10 is allowed to set in place. Depending upon the material used, marking 10 heated in situ to a temperature within the range of 100°–400° F., or more particularly 150°–350° F. Optionally marking 10 and/or substrate 12 may be pre-heated prior to placement of marking 10 at the work site.

Markings 10 may be applied directly on an upper or other exposed surface of substrate 12 or may be in-laid within substrate 12, either partially or entirely. In some applications in-laid markings 10 may be preferred since they have less tendency to wear than exposed markings. Marking 10 may be compressed into substrate 12, for example, with a mechanical compactor, such as a vibrating plate compactor 16 or a drum roller. In other applications it may be beneficial for markings 10 to project above substrate 12. This may be useful, for example, in regulating the speed of vehicles traversing a paved roadway or the like. In one embodiment of the invention, the applicant's method could be employed to form an inlaid pattern in a substrate 12 where only the edge portion(s) of the marking 10 are inlaid. For example, a thermoplastic inlaid traffic marking 10 having a gently curved upper surface could be provided. An impression could be formed in substrate 12 conforming to the contour of the periphery of the marking 10. The impression could be formed so that only edge portions of the marking 10 are inlaid to ensure that the edges will not be caught by snow plows in regions having winter snowfalls. Further, the curvature of the marking 10 could enhance the reflectivity of the thermoplastic material to improve traffic safety.

As will be appreciated by a person skilled in the art, the gradual heating method shown in FIGS. 1–3 could be used to facilitate adherence of thermoplastic or other settable markings 10 which are relatively large in size, such as in-laid or projecting traffic markings. One advantage of this approach in comparison to conventional painted-on traffic markings is that the installation process is not weather dependent. Also, marking 10 would not become obliterated by wear of the surface layer (i.e. since the marking color would extend consistently throughout the thickness of the marking).

In still further alternative embodiments of the invention heating apparatus 14 may be modified to include one or more heat sensors 28 for sensing the temperature of substrate 12 (FIG. 1). The heat sensors 28 could be mounted on truck 26 to travel over substrate 12 and scan the temperature thereof. Apparatus 14 may also include a controller for switching off one or more of the heaters 18 in the heater bank depending upon the measured surface temperature. For example, once the surface temperature achieves a target value, some of the heaters 18 could be switched off to prevent further heating and possible scorching of marking 10 or substrate 12 while other heaters 18 could remain on to maintain the surface temperature at or near the target value. Alternatively, the height, speed or heating intensity of some or all of the heaters 18 could be adjusted depending upon the sensed temperature.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of binding a thermally settable marking to a substrate comprising:

(a) positioning said marking on said substrate;

(b) gradually heating said marking and said substrate in situ by periodically passing at least one heater in proximity to said substrate; and (c) allowing said marking to bind to said substrate when said marking is heated to a sufficiently pliable state, wherein said gradual heating comprises providing a heating apparatus having a support frame extending over said marking, wherein said heater is mounted for movement on said support frame in a travel path which periodically passes over said marking to thereby gradually increase the temperature thereof.

2. The method as defined in claim 1, wherein said heater moves in a reciprocating motion in said travel path.

3. The method as defined in claim 1, comprising a plurality of heaters coupled to said support frame.

4. The method as defined in claim 3, further comprising a heat sensor for sensing the temperature of said substrate in the vicinity of said marking and a controller for controlling the operation of said plurality of heaters based on said temperature.

5. The method as defined in claim 1, wherein the surface area of said substrate traversed by said heater during said travel path exceeds 10 square feet.

6. The method as defined in claim 1, wherein visual monitoring of said marking is not obstructed by said heating apparatus when said heater is at a location in said travel path removed from said marking.

* * * * *